US006528746B2

(12) United States Patent
DeWitt et al.

(10) Patent No.: US 6,528,746 B2
(45) Date of Patent: Mar. 4, 2003

(54) ELECTRICAL CONNECTOR SYSTEM

(75) Inventors: Donald E. DeWitt, Syracuse, IN (US); John W. Burwell, Rome City, IN (US)

(73) Assignee: Lyall Assemblies, Inc., Albion, IN (US)

( * ) Notice: Subject to any disclaimer, the term of this patent is extended or adjusted under 35 U.S.C. 154(b) by 0 days.

(21) Appl. No.: 09/844,802

(22) Filed: Apr. 27, 2001

(65) Prior Publication Data

US 2002/0157932 A1 Oct. 31, 2002

(51) Int. Cl.[7] ..... H01R 33/96

(52) U.S. Cl. ..... 200/51.09; 335/205; 335/207; 439/38; 439/188

(58) Field of Search ..... 200/51 R, 51.09, 200/51.11, 51.13, 61.02, 43.02, 333; 335/205–207; 439/38–40, 188

(56) References Cited

U.S. PATENT DOCUMENTS

| | | | | |
|---|---|---|---|---|
| 2,573,920 A | | 11/1951 | McLeod | 200/51.09 |
| 3,159,725 A | | 12/1964 | Dennis | 200/51.09 |
| 3,868,160 A | | 2/1975 | Kersman | 339/12 |
| 4,242,657 A | | 12/1980 | Chaillot | 335/207 |
| 4,317,969 A | | 3/1982 | Riegler et al. | 200/52 |
| 4,527,217 A | * | 7/1985 | Muller-Girard et al. | 200/51 R |
| 4,591,732 A | * | 5/1986 | Neuenschwander | 200/51 R |
| 4,616,285 A | | 10/1986 | Sackett | 361/1 |
| 4,647,120 A | * | 3/1987 | Karabakakis | 200/51.09 |
| 4,772,215 A | * | 9/1988 | Falk | 200/51.09 |
| 5,659,209 A | * | 8/1997 | Huen | 200/43.02 |
| 5,829,987 A | * | 11/1998 | Fritsch et al. | 200/51.09 |
| 6,183,264 B1 | | 2/2001 | Harsányi | 439/38 |

FOREIGN PATENT DOCUMENTS

| | | | |
|---|---|---|---|
| FR | 2232101 | 6/1973 | H01R/19/40 |

* cited by examiner

*Primary Examiner*—Michael Friedhofer
(74) *Attorney, Agent, or Firm*—Taylor & Aust, P.C.

(57) ABSTRACT

A connector system, including two electrical connectors configured to mate together; one electrical connector containing a magnetic flux responsive device configured for generating an electrical signal; the other electrical connector containing a magnet which is located in association with the magnetic flux responsive device when the two electrical connectors are mated together.

31 Claims, 4 Drawing Sheets

ELECTRICAL CONNECTOR SYSTEM

BACKGROUND OF THE INVENTION

1. Field of the Invention

The present invention relates to electrical connectors, and, more particularly, to electrical connectors with a mating sensor.

2. Description of the Related Art

Electrical connectors are well known in the art and often include a male connector and a female connector with keying elements to ensure proper orientation before mating the two connectors. Such keying elements prevent physical mating of mechanically incompatible connectors, but do not allow for the remote sensing that a connector is physically engaged allowing the circuit to be tested prior to applying power or signals.

Also well known in the art are remotely energized circuits which utilize electrical connectors.

A problem encountered with engaging connectors which have electrically live contacts is the arcing between contacts which can diminish the useful life of the contacts and pose other concerns.

What is needed in the art is a connector system that includes a mating sensor which would allow for the selective activation of conductors in the connector system.

SUMMARY OF THE INVENTION

The present invention provides an apparatus and a method to delay the excitation of the conductors of a connector system until after the contacts of two connectors are engaged, which is accomplished by the proximate locating of a sensor triggering element in one connector to a sensor in the other connector causing the generation of an electrical signal that is used as a command to apply power or signals to the conductors.

The invention comprises, in one form thereof, a connector system including two electrical connectors configured to mate together; one electrical connector containing a magnetic flux responsive device configured for generating an electrical signal; the other electrical connector containing a magnet which is located in association with the magnetic flux responsive device when the two electrical connectors are mated together.

An advantage of the present invention is that electrical connections can be achieved without any electrical arcing, thus reducing the chance of explosion in an explosive environment.

Another advantage is that the device provides a safer connector in areas of high moisture, in that if the connector is unengaged and is placed in a conducting liquid the possibility of causing injury to people or machinery is eliminated.

Yet another advantage is that accidental insertion of a conductive item into the electrical connections will not result in injury.

Yet still another advantage is that the signals may be centrally controlled by sensing a coupling of the connectors.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
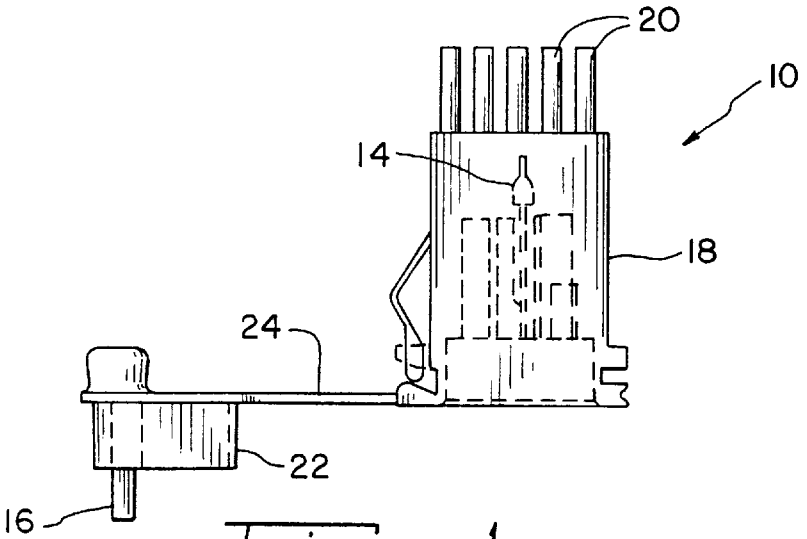
FIG. 1 is a top view of a female electrical connector used in the electrical connector system of the present invention.
Figure 2:
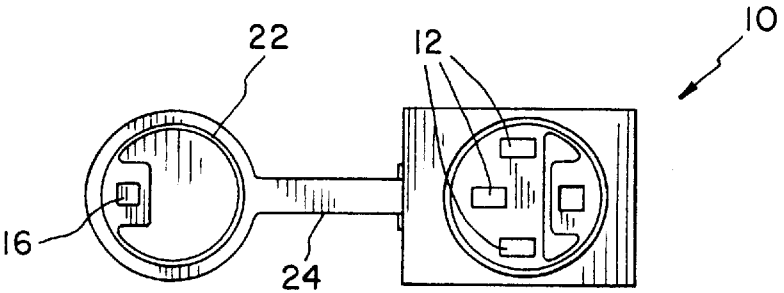
FIG. 2 is a front view of the electrical connector shown in FIG. 1.
Figure 3:
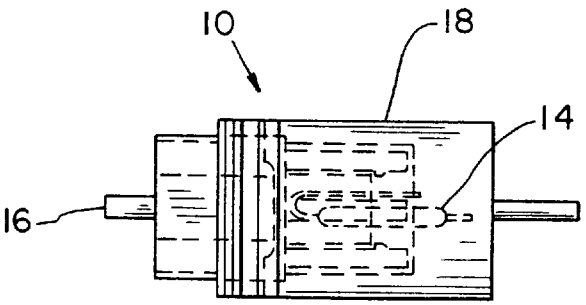
FIG. 3 is a side view of the electrical connector shown in FIGS. 1 and 2.
Figure 4:
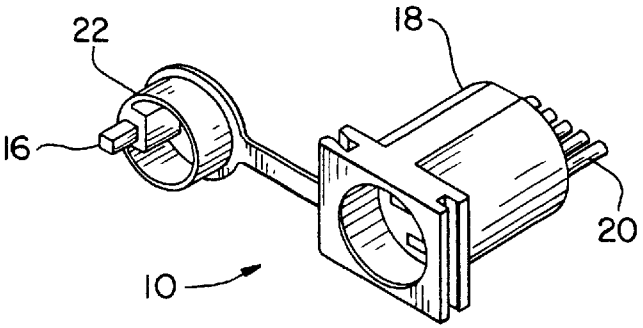
FIG. 4 is a perspective view of the electrical connector shown in FIGS. 1–3.
Figure 8:
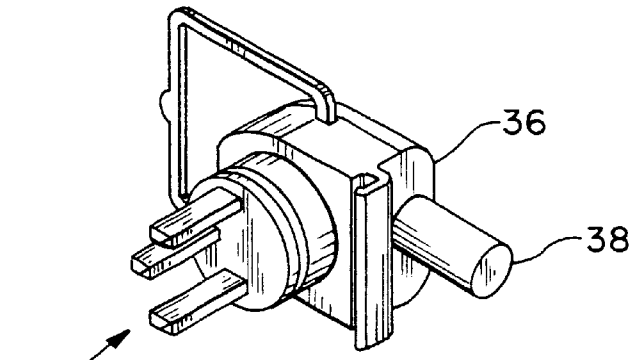
FIG. 8 is a perspective view of the electrical connector shown in FIGS. 5–7.
Figure 7:
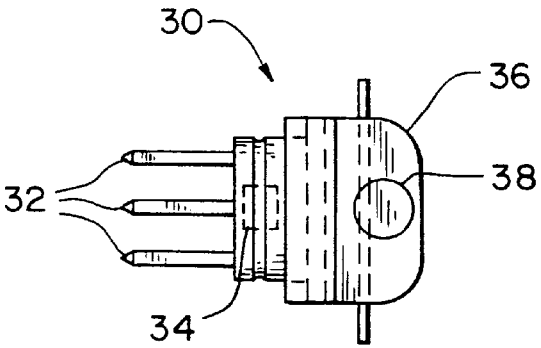
FIG. 7 is a side view of the electrical connector shown in FIGS. 5 and 6.
Figure 5:
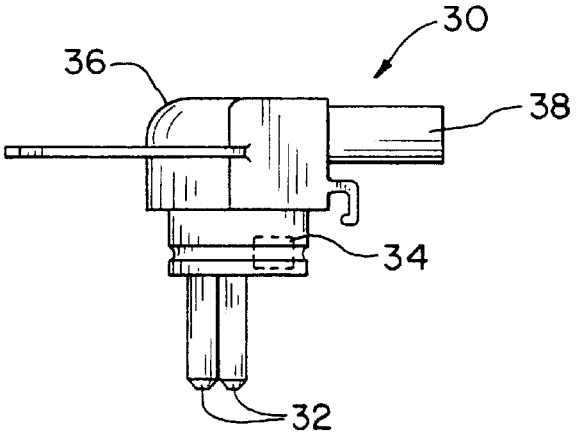
FIG. 5 is a top view of a male electrical connector which mates with the female electrical connector shown in FIGS. 1–4.
Figure 6:
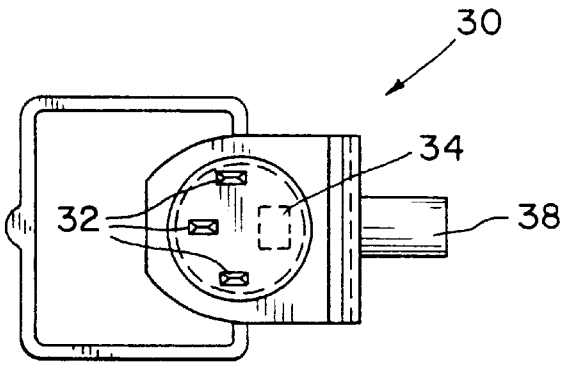
FIG. 6 is a front view of the electrical connector shown in FIG. 5.
Figure 12:
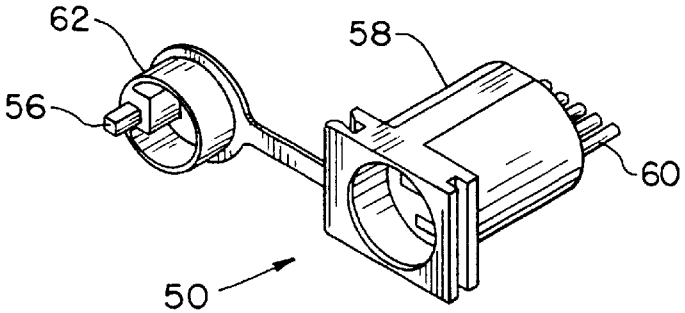
FIG. 12 is a perspective view of the electrical connector shown in FIGS. 9–11.
Figure 11:
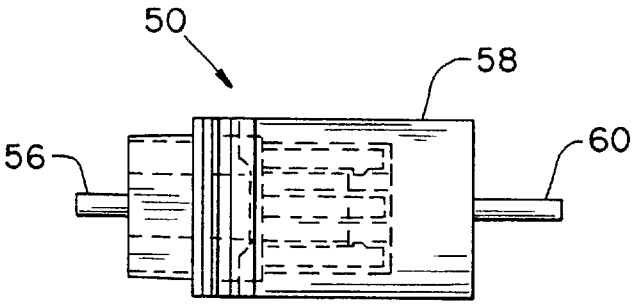
FIG. 11 is a side view of the electrical connector shown in FIGS. 9 and 10.
Figure 9:
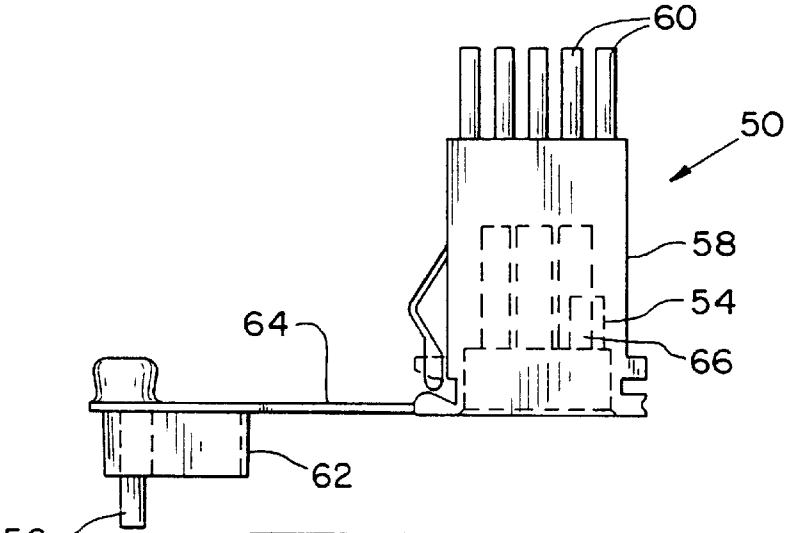
FIG. 9 is a top view of another embodiment of a female electrical connector used in the electrical connector system of the present invention.
Figure 10:
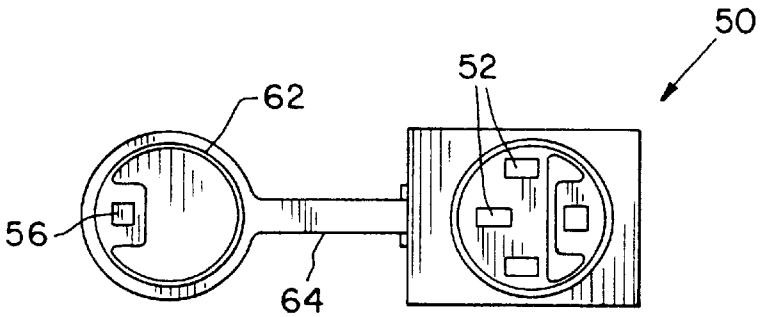
FIG. 10 is a front view of the electrical connector shown in FIG. 9.
Figure 13:
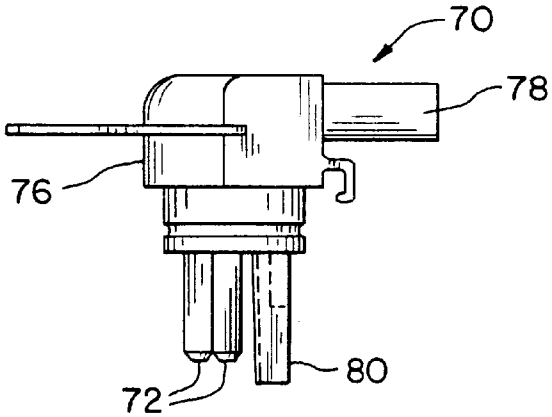
FIG. 13 is a top view of a male electrical connector which mates with the female electrical connector shown in FIGS. 9–12.
Figure 14:
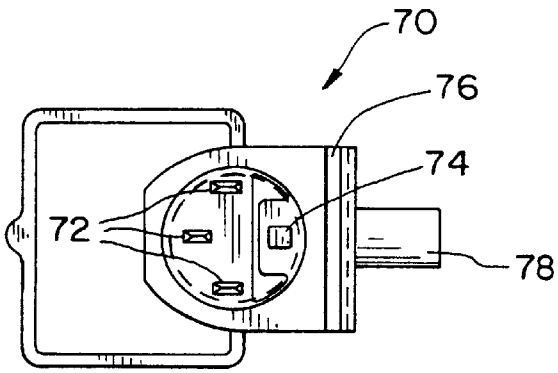
FIG. 14 is a front view of the electrical connector shown in FIG. 13.
Figure 15:
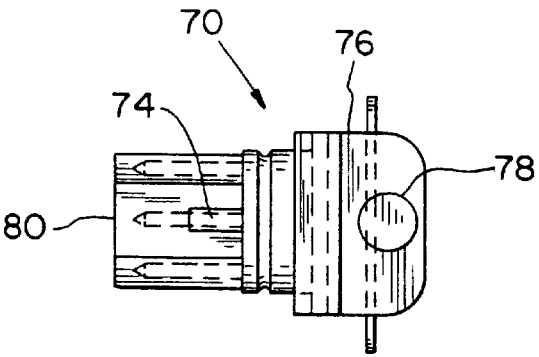
FIG. 15 is a side view of the electrical connector shown in FIGS. 13 and 14.
Figure 16:
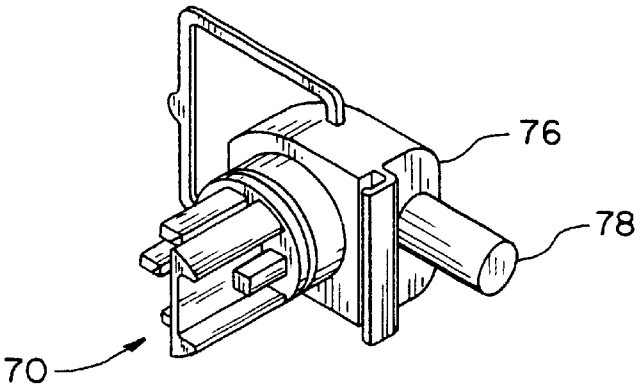
FIG. 16 is a perspective view of the electrical connector shown in FIGS. 14–15.

Referring now to the drawings, and more particularly to FIGS. 1–4, there is shown a female electrical connector 10 including a plurality of electrical contacts 12 for the distribution of power or signals, sensor 14, sensor triggering element 16, connector body 18, a plurality of electrical conductors 20, connector cap 22 and connector cap tether 24. Sensor 14 is positioned such that it may interact with sensor triggering element 16 of electrical connector 10 or sensor triggering element 34 of electrical connector 30 of FIG. 5.

Now additionally referring to FIGS. 5–8 there is shown a male electrical connector 30 which mates with female connector 10 shown in FIGS. 1–4. Male electrical connector 30 includes a plurality of electrical contacts 32 for the distribution of power or signals, sensor triggering element 34, connector body 36 and a plurality of electrical conductors 38. Sensor triggering element 34 is fully encapsulated in electrical connector 30 as is shown in FIGS. 5–8, however sensor triggering element 34 may alternatively protrude from electrical connector 30.

In one embodiment of the invention, sensor triggering element 16 is a magnet and sensor 14 may include magnetic flux responsive devices, Hall effect devices, Mosfet transistors and reed switches. Electrical contacts 12 remain unenergized until electrical contacts 32 of electrical connector 30 are engaged therewith, and electrical contacts 12 will de-energize prior to being fully disengaged from electrical contacts 32. This is accomplished by the use of sensor 14, which is fully encapsulated in electrical connector 10. As electrical contacts 32 are engaged with electrical contacts 12 the magnetic flux of sensor triggering element 34 will cause sensor 14 to change its electrical characteristic. The change in the electrical characteristics of sensor 14 is conveyed through some of electrical conductors 20 to a control device, not a part of this invention, which then energizes some of the other electrical conductors 20.

An alternate embodiment of this invention connects sensor 14 in series with one of electrical conductors 20 and with one of electrical contacts 12. This embodiment energizes electrical contact 12 without the need for a control device.

In either embodiment as electrical connector 30 is disengaged from electrical connector 10 the flux of sensor triggering element 34 decreases in the area of sensor 14 causing the electrical characteristic of sensor 14 to change resulting in a de-energizing of electrical contacts 12.

The timing of these events can be controlled by ensuring that the physical length of electrical contacts 32 are such that they will be engaged prior to sensor triggering element 34 being in sufficient proximity with sensor 14 for the electrical characteristic of sensor 14 to change. In a like manner as electrical connector 30 is being disengaged from electrical connector 10 the electrical characteristic of sensor 14 will change prior to electrical contacts 32 are disengaged from electrical contacts 12.

In another embodiment of the invention, sensor 14 may be electrically connected to other sensors of other connectors of the present invention in order to control when all of the connectors are energized. If it is desirable to energize the connectors and there is no electrical connector 30 to mate with an electrical connector 10, then engaging connector cap 22 with electrical connector 10 such that sensor triggering element 16 is positioned proximate sensor 14 will achieve the desired goal.

The act of coupling male connector 30 with female connector 10 is accomplished by orienting male connector 30 and female connector 10 to align their respective contacts, engaging electrical contacts 12 and 32, and as electrical contacts 12 and 32 are being fully engaged sensor triggering element 34 comes into proximity with sensor 14 causing the electrical characteristics of sensor 14 to alter generating an electrical signal. The electrical signal generated by sensor 14 during the coupling process is then utilized to cause power and/or signals to be applied to some of conductors 20. Since conductors 20 are now electrically connected to conductors 38 through contacts 12 and 32, power and/or signals are passed to the termination of conductors 38.

In yet another embodiment of the invention, referring now to FIGS. 9–16, there is shown a female electrical connector 50 including a plurality of electrical contacts 52 for the distribution of power or signals, sensor 54, sensor triggering element 56, connector body 58, a plurality of electrical conductors 60, connector cap 62, connector cap tether 64 and triggering source 66. Sensor 54 and triggering source 66 are positioned such that they may interact with sensor triggering element 56 of electrical connector 50 or sensor triggering element 74 of electrical connector 70. Electrical connector 70 includes a plurality of electrical contacts 72 for the distribution of power or signals, sensor triggering element 74, connector body 76, a plurality of electrical conductors 78 and connector key 80. Sensor triggering element 74, which is shown in FIGS. 13–16 as protruding from electrical connector 70, may alternatively be of a non-protruding nature and may be fully encapsulated in electrical connector 70.

Sensor 54 and triggering source 66 are located in electrical connector 50 such that triggering source 66 does not activate sensor 54 unless sensor triggering element 74 of electrical connector 70 directs the triggering attribute of triggering source 66 such that it will alter the electrical characteristics of sensor 54.

In the foregoing embodiments triggering source 66 may be a magnet; sensor 54 includes a reed switch, a Mosfet transistor, a Hall effect device or any magnetic flux responsive device; sensor triggering element 74 is a material with a magnetic permeability sufficient to cause sensor 54 to generate an electrical signal by the conduction of flux from triggering source 66, which is physically configured as either a protruding or non-protruding part of electrical connector 70. In a similar fashion triggering source 66 may be a light source of predetermined wavelength; sensor 54 includes a phototransistor or any light responsive device which will respond to triggering source 66; sensor triggering element 74 is a material with either an optically conductive property or a light absorbing characteristic which is shown protruding in FIGS. 13–16, but alternatively may be of a non-protruding nature; triggering source 66 and sensor 54 may be configured such that the connection of electrical connector 50 with electrical connector 70 causes the light of triggering source 66 to be conducted to sensor 54 causing a change in the electrical characteristics of sensor 54; or triggering source 66 and sensor 54 may be configured such that the engaging of electrical connector 50 with electrical connector 70 causes sensor triggering element 74 to block the light of triggering source 66 so that it will not arrive at sensor 54 causing a change in the electrical characteristics of sensor 54.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A connector system, comprising:

a first electrical connector including a magnetic flux responsive device configured for generating an electrical signal; a second electrical connector configured to mate with said first electrical connector, said second electrical connector including a magnet located in association with said magnetic flux responsive device when said first electrical connector and said second electrical connector are mated together; and a connector cap configured to mate with at least one of said first electrical connector and said second connector, said connector cap including a magnet located in association with said magnetic flux responsive device when said connector cap and said first electrical connector are mated together.

2. The system of claim 1, wherein said first electrical connector and said second electrical connector each include at least one electrical contact and at least one electrical conductor, said at least one electrical contact being electrically connected to a corresponding one of said at least one electrical conductor.

3. The system of claim 2, further comprising a control device configured to sense said electrical signal and in response to said electrical signal connect one of power and information signals to said at least one conductor of said first electrical connector.

4. The system of claim 2, wherein said at least one electrical contact of said first electrical connector is configured to mate with said at least one electrical contact of said second electrical connector.

5. The system of claim 1, wherein said magnetic flux responsive device is one of a reed switch and a Hall effect device.

6. The system of claim 1, wherein said first electrical connector includes a nonconductive encapsulant, said nonconductive encapsulant fully enclosing said magnetic flux responsive device.

7. The system of claim 1, wherein said second electrical connector includes a nonconductive encapsulant, said nonconductive encapsulant at least partially enclosing said magnet.

8. A connector system, comprising:

an electrical connector including a magnetic flux responsive device configured for generating an electrical signal; and a connector cap configured to mate with said electrical connector, said connector cap including a magnet located in association with said magnetic flux responsive device when said connector cap and said electrical connector are mated together.

9. The system of claim 8, wherein said electrical connector includes at least one electrical contact and at least one electrical conductor, said at least one electrical contact being electrically connected to a corresponding one of said at least one electrical conductor.

10. The system of claim 8, wherein said magnetic flux responsive device is one of a reed switch and a Hall effect device.

11. The system of claim 8, wherein said electrical connector includes a nonconductive encapsulant, said nonconductive encapsulant fully enclosing said magnetic flux responsive device.

12. The system of claim 8, wherein said connector cap includes a nonconductive encapsulant, said nonconductive encapsulant at least partially enclosing said magnet.

13. A connector system, comprising:

a first electrical connector including a magnet and a magnetic flux responsive device configured for generating an electrical signal; and a second electrical connector configured to mate with said first connector, said second connector including an element with a magnetic permeability which is sufficient to conduct flux from said magnet to said magnetic flux responsive device thereby generating said electrical signal when said first electrical connector and said second electrical connector are mated together.

14. The system of claim 13, wherein said first electrical connector and said second electrical connector each include at least one electrical contact and at least one electrical conductor, said at least one electrical contact being electrically connected to a corresponding one of said at least one electrical conductor.

15. The system of claim 14, wherein said at least one electrical contact of said first electrical connector is configured to mate with said at least one electrical contact of said second electrical connector.

16. The system of claim 13, wherein said magnetic flux responsive device is one of a reed switch and a Hall effect device.

17. The system of claim 13, wherein said first electrical connector includes a nonconductive encapsulant, said nonconductive encapsulant at least partially enclosing at least one of said magnetic flux responsive device and said magnet.

18. A connector system, comprising:

a first electrical connector including a light source and a light responsive device configured for generating an electrical signal; and a second electrical connector configured to mate with said first electrical connector, said second electrical connector including at least one of a light absorbing element and a light conducting element being positioned within said second connector in association with said light source and said light responsive device when said first electrical connector and said second electrical connector are mated together.

19. The system of claim 18, wherein said first electrical connector and said second electrical connector each include at least one electrical contact and at least one electrical conductor, said at least one electrical contact being electrically connected to a corresponding one of said at least one electrical conductor.

20. The system of claim 19, wherein said at least one electrical contact of said first electrical connector is configured to mate with said at least one electrical contact of said second electrical connector.

21. The system of claim 18, wherein said light responsive device includes a photo transistor.

22. The system of claim 18, wherein said light conducting element includes one of a fiber optic loop, a prismatic mirror, a light conductive plastic and a flat mirror.

23. A connector system, comprising:

an electrical connector including a light source and a light responsive device configured for generating an electrical signal; and a connector cap configured to mate with said electrical connector, said connector cap including at least one of a light absorbing element and a light conducting element being positioned within said connector cap in association with said light source and said light responsive device when said connector cap and said electrical connector are mated together.

24. The system of claim 23, wherein said electrical connector includes at least one electrical contact and at least one electrical conductor, said at least one electrical contact being electrically connected to a corresponding one of said at least one electrical conductor.

25. The system of claim 23, wherein said light responsive device includes a photo transistor.

26. The system of claim 23, wherein said electrical connector includes a nonconductive encapsulant, said nonconductive encapsulant enclosing, but not optically inhibiting, said light responsive device and said light source.

27. A method of providing delayed excitation of the contacts of a connector system, said method, comprising the steps of:

positioning a sensor in a first electrical connector, said first electrical connector having at least one electrical contact, said sensor configured for generating an electrical signal;

locating a sensor triggering element in a second electrical connector, said second electrical connector having at least one electrical contact, said second electrical connector being configured to mate with said first electrical connector, said sensor triggering element located in association with said sensor when said first electrical connector and said second electrical connector are mated together;

providing a connector cap configured to mate with at least one of said first electrical connector and said second connector, said connector cap including a sensor triggering element located in association with said sensor when said connector cap and said first electrical connector are mated together;

orienting said first connector to align with said second connector;

engaging said first connector with said second connector; and generating said electrical signal when said triggering element is proximate to said sensor, dependent upon said engaging step.

28. The method of claim 27, wherein said sensor triggering element is a magnet and said sensor is at least one of a magnetically responsive device, a Hall effect device and a reed switch.

29. The method of claim 27, further comprising the step of utilizing said electrical signal to cause said electrical contacts of said first electrical connector and said electrical contacts of said second connector to be electrically excited.

30. A method of providing delayed excitation of the contacts of a connector system, said method, comprising the steps of:

positioning a sensor in a first electrical connector, said first electrical connector having at least one electrical contact, said sensor configured for generating an electrical signal;

locating a sensor triggering element in a second electrical connector, said second electrical connector having at least one electrical contact, said second electrical connector being configured to mate with said first electrical connector, said sensor triggering element located in association with said sensor when said first electrical connector and said second electrical connector are mated together;

orienting said first connector to align with said second connector;

engaging said first connector with said second connector; and generating said electrical signal when said triggering element is proximate to said sensor, dependent upon said engaging step;

wherein said sensor triggering element is a light conductor, said sensor including a light responsive device and a light source being configured such that the light from said light source is not detected by said light responsive device until said light conductor is positioned to enable the light from said light source to be transmitted to said light responsive device.

31. A method of providing delayed excitation of the contacts of a connector system, said method, comprising the steps of:

positioning a sensor in a first electrical connector, said first electrical connector having at least one electrical contact, said sensor configured for generating an electrical signal;

locating a sensor triggering element in a second electrical connector, said second electrical connector having at least one electrical contact, said second electrical connector being configured to mate with said first electrical connector, said sensor triggering element located in association with said sensor when said first electrical connector and said second electrical connector are mated together;

orienting said first connector to align with said second connector;

engaging said first connector with said second connector; and generating said electrical signal when said triggering element is proximate to said sensor, dependent upon said engaging step;

wherein said sensor triggering element is a light absorber, said sensor includes a light responsive device and a light source being configured such that the light from said light source is detected by said light responsive device until said light absorber is positioned to prevent the light from said light source to be transmitted to said light responsive device.

* * * * *